US006788914B1

(12) United States Patent
Wasai

(10) Patent No.: US 6,788,914 B1
(45) Date of Patent: Sep. 7, 2004

(54) IMAGE FORMING APPARATUS

(75) Inventor: Akihiro Wasai, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/391,621

(22) Filed: Mar. 20, 2003

(51) Int. Cl.[7] ..... G03G 15/00
(52) U.S. Cl. ..... 399/301; 347/116; 399/167
(58) Field of Search ..... 399/46, 49, 167, 399/299, 301; 347/116

(56) References Cited

U.S. PATENT DOCUMENTS

| | | | | |
|---|---|---|---|---|
| 5,550,625 A | * | 8/1996 | Takamatsu et al. | 399/301 |
| 5,881,346 A | * | 3/1999 | Mori et al. | 399/301 |
| 6,278,857 B1 | * | 8/2001 | Monji et al. | 399/301 |
| 6,335,747 B1 | | 1/2002 | Munakata | |
| 6,408,157 B1 | * | 6/2002 | Tanaka et al. | 399/301 |

FOREIGN PATENT DOCUMENTS

| | | |
|---|---|---|
| JP | 11-218989 A | 8/1999 |
| JP | 11-223973 A | 8/1999 |
| JP | 2001-228679 A | 8/2001 |

* cited by examiner

*Primary Examiner*—Hoan Tran
(74) *Attorney, Agent, or Firm*—Foley & Lardner LLP

(57) ABSTRACT

An image forming apparatus is configured to develop a latent image corresponding to a line-like image of a predetermined pitch on photosensitive bodies provided for respective colors for a color image formation and rotatable about a predetermined axis and transfer the developed image to a transfer belt. The apparatus detects the presence or absence of any line from the transferred line-like image for respective colors and calculates a phase displacement, from a phase of a reference photosensitive drum, of the phases of the other photosensitive drums on the basis of waveforms calculated from the detected line pitches for respective colors. The apparatus adjusts the rotation positions of these other photosensitive drums to allow the phases of these other photosensitive bodies to be substantially matched to the phase of that given photosensitive body.

6 Claims, 6 Drawing Sheets

IMAGE FORMING APPARATUS

BACKGROUND OF THE INVENTION

1. Field of the Invention

The present invention relates to an image forming apparatus and, in particular, to an image forming apparatus for preventing color mismatching, by rotating photosensitive bodies for respective colors in a matched state, and a method for preventing a color mismatch in the image forming apparatus.

2. Description of the Related Art

Known is an image forming apparatus for forming a color image by arranging image forming sections for colors such as yellow (Y), magenta (M), cyan (C) and black (K) near a transfer belt along a running direction of the transfer belt and allowing images based on image data for respective colors to be color matched. The respective image forming section of this apparatus comprises a photosensitive drum, a control section configured to allow a light exposure to be applied to the photosensitive body, a developing agent supply section, and so on. In the image forming apparatus thus formed, it is considered necessary to set the portions of respective drums over a transfer belt and, by drawing lines on the transfer belt with an integral multiple of a circumference length of the drum and detecting the lines, a light exposure timing is controlled to prevent any adverse effect exerted by a rotation vibration on a transfer surface during a rotation of the drum about a drum shaft. By doing so, an image of respective color components is transferred to the transfer belt, avoiding color mismatching.

In the case where, however, a rotation vibration is involved in the photosensitive drum itself, an image interval to be formed on the transfer belt varies during a rotation cycle of the photosensitive drum and there occurs a matched image on the transfer belt at some area but there sometimes arises a color mismatch on the transferred image at other areas. As a result, image quality formed in the image forming apparatus is somewhat lowered.

Therefore, there is a need for an image forming apparatus which prevent an image from being transferred from the photosensitive drum for respective colors onto a transfer surface throughout the rotation cycle of the drum in a color-mismatched state.

BRIEF SUMMARY OF THE INVENTION

According to an aspect of the present invention, there is provided an image forming apparatus comprising photosensitive bodies each rotatable about a predetermined axis and configured to from a color image for respective colors; light exposure sections provided for the respective colors and configured to form a latent image corresponding to a line-like image of a predetermined pitch in an axial direction of the respective photosensitive body; developing sections provided for the respective colors and configured to supply a developing agent corresponding to the respective photosensitive body to allow the latent image which corresponds to the line-like image of the predetermined pitch to be developed; and a transfer belt configured to allow the developed line-like image of a predetermined pitch to be transferred. Further, the apparatus includes sensors each arranged at a predetermined position and configured to detect the presence or absence of any line of the line-like image for the respective colors transferred to the transfer belt, and an adjusting section configured to, based on the phases of waveforms for respective colors calculated from the pitch of the lines which has been detected, relative to the phase of a given photosensitive body adjust the rotation positions of the other photosensitive bodies to allow the phases of the other photosensitive bodies to be substantially matched to the phase of the given photosensitive body.

Objects and advantages of the invention will become apparent from the description which follows, or may be learned by practice of the invention.

BRIEF DESCRIPTION OF THE SEVERAL VIEWS OF THE DRAWING

The accompanying drawings illustrate embodiments of the invention, and together with the general description given above and the detailed description given below, serve to explain the principles of the invention.

DETAILED DESCRIPTION OF THE INVENTION

Figure 1:
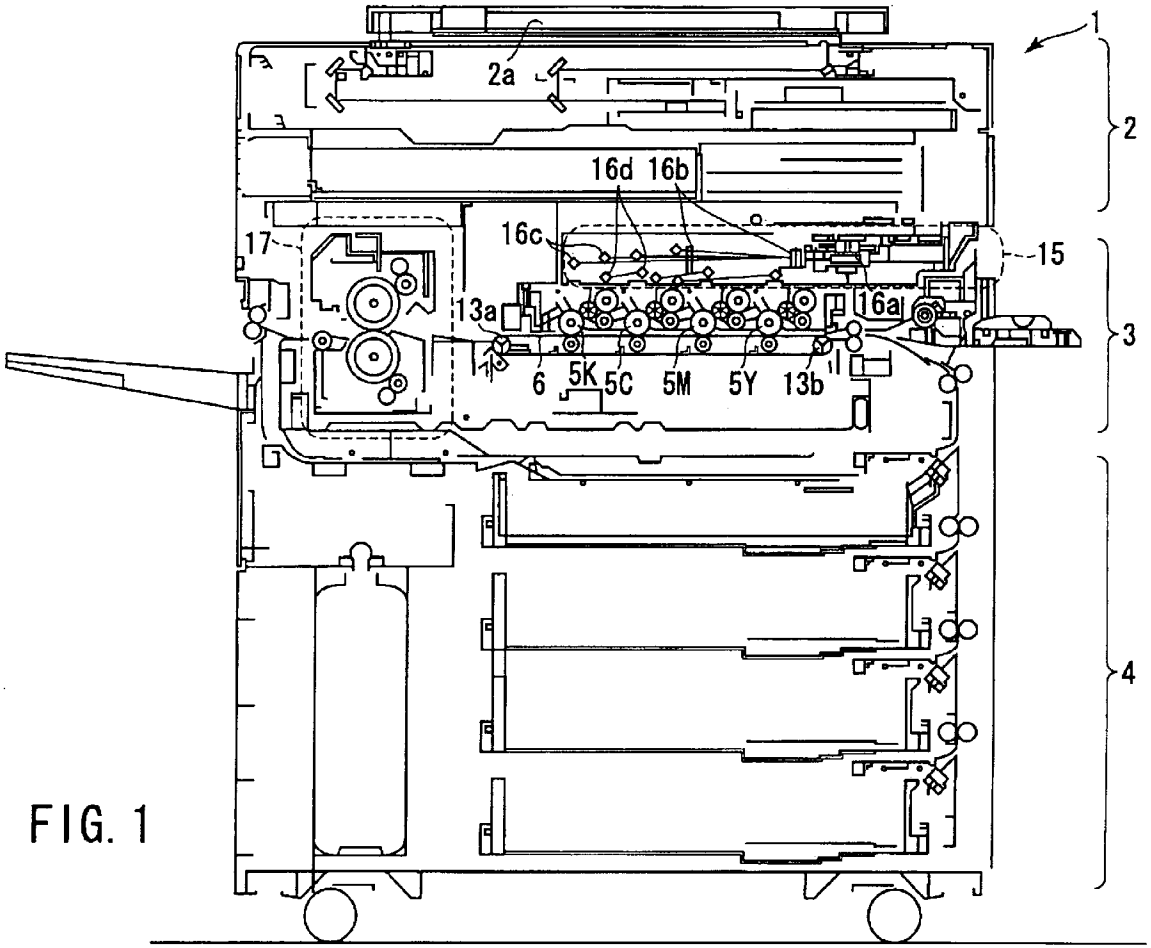
FIG. 1 is a view showing a general arrangement of a color copier according to one embodiment of the present invention.

With reference to the drawing an explanation will be made below about the respective embodiments of the present invention.

(First Embodiment)

FIG. 1 is a view diagrammatically showing a structure of a four-series type color copier 1 having a plurality of electrophotographic image forming sections arranged relative to the same transfer belt. The color copier 1 has a scanner section 2, a printer section 3 and a sheet supply section 4. The color copier 1 has a document glass 2*a* where a document, such as a to-be-copied material, is placed. The copier scans an image of the document on the document glass 2*a*, applies a predetermined process to the scanned image data and, by doing so, forms a color image. As a type of image data used for forming an image in a color copier 1, use is made of, for example, image data of yellow (Y), magenta (M), cyan (C) and black (K) color components which are generated from red (R), green (G), and blue (B) colors of image data corresponding to a scanned document image.

Figure 2:
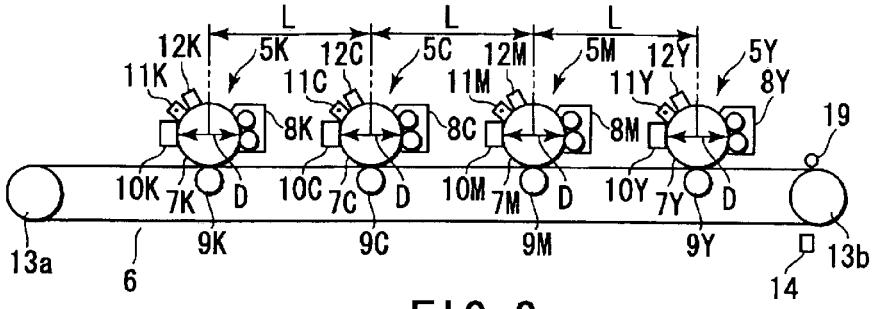
FIG. 2 is a view showing an arrangement of a transfer belt and respective image forming section.

The .printer section 3 has image forming sections 5Y, 5M, 5C and 5K configured to form an image corresponding to the Y, M, C and K color components. The image forming sections 5Y, 5M, 5C and 5K are arranged at predetermined intervals in an opposed relation relative to an endless type transfer belt 6 for conveying a sheet, etc., and at predetermined intervals L relative to the belt along a plane direction of the transfer belt 6. It is to be noted that FIG. 2 shows an arrangement of the transfer belt 6 and image forming sections 5Y, 5M, 5C and 5K. In this embodiment, the image forming sections 5Y, 5M, 5C and 5K are arranged in that order as viewed from an upstream side of a sheet conveying direction.

In the image forming sections 5Y, 5M, 5C and 5K, corresponding photosensitive drum 7Y, 7M, 7C and 7K are provided so as to allow latent image corresponding to image data of Y, M, C and K to be formed. Further, in the image forming sections 5Y, 5M, 5C and 5K, developing units 8Y, 8M, 8C and 8K are incorporated each with a toner of a respective color (Y, M, C, K) held there to allow the latent images formed on the photosensitive drums 7 to be made a visible image.

Around the photosensitive drums 7Y, 7M, 7C and 7K of the image forming sections 5Y, 5M, 5C and 5K, transfer units 9Y, 9M, 9C and 9K are respectively arranged to allow corresponding toner images, which are formed on the corresponding drums 7, to be transferred, under electrostatic attraction, to a conveying sheet on a transfer belt 6 in a sandwiched state. Further around the photosensitive drums 7Y, 7M, 7C and 7K cleaners 10Y, 10M, 10C and 10K, charge eliminators 11Y, 1M, 11C and 11K and chargers 12Y, 12M, 12C and 12K are arranged respectively, the cleaner being used to eliminate a residual toner on the drum left after a toner image has been transferred to the sheet by the transfer unit, the charge eliminator being used to eliminate a charge remaining on the drum after the toner has been cleaned by the cleaner, and the charger being used to apply a predetermined charge to the drum.

The transfer belt 6 is tensioned between a drive roller 13*a* and a driven roller 13*b*. By rotating the drive roller 13*a* the transfer belt 6 is run in a predetermined direction. At a predetermined position near the driven roller 13*b*, an attraction charger 14 is provided to electrostatically charge the sheet to allow the sheet to be attracted to the transfer belt 6. At a somewhat downstream side in a sheet conveying direction at a position where a sheet from the sheet supply section 4 is set in contact with the transfer belt 6, an attraction roller 19 is arranged to allow the sheet to be set in close contact with the transfer belt 6 which is electrically charged by the attraction charger 14.

At a predetermined position above each image forming section (5Y, 5M, 5C, 5K) of the printer section 3, a light exposure unit 15 is provided to allow an image forming signal, which is image-processed for each color image data by a later-described control section 51, to be illuminated with a corresponding color laser beam at an image forming timing. In accordance with the image forming signal corresponding to each color, the light exposure unit 15 allows its own emitting laser beam to, while deflecting the beam by a polygon mirror 16*a*, etc., in an axial direction of the respective photosensitive drum (7Y, 7M, 7C and 7K), be directed by a plurality of cylindrical lenses 16*b* and plane mirrors 16*c*, 16*d*, etc., onto the photosensitive drums 7Y, 7M, 7C, 7K in a sequential fashion. By doing so, electrostatic latent images corresponding to the respective colors are formed on the photosensitive drums 7Y, 7M, 7C and 7K.

In a direction in which the sheet is conveyed on the transfer belt 6, a fixing unit 17 is provided for allowing a toner image of four colors borne on the sheet to be fixed to the sheet. The fixing unit 17 comprises a heating roller having an inside heater and a pressing roller (not shown). The fixing unit 17 allows a sheet to pass between the heating roller and the pressing roller, while applying a predetermined pressure between the heating roller and the pressing roller, and electrostatically deposited toner on the sheet is fixed to the sheet under both heating and pressure. Thus, the color copier 1 forms a color image on the sheet.

Further, the color copier 1 has a color mode for forming a color image and a monochrome mode for forming a monochrome image. In the color mode, a color image is so formed that the photosensitive drums 7Y, 7M, 7C and 7K for Y, M, C and K colors are set in close contact with the transfer belt 6. In the monochrome mode, the photosensitive drum 7K for black color K is set in close contact with the transfer belt 6 to form an image, in which case the photosensitive drums 7Y, 7M and 7C for Y, M, C colors are set away from the transfer belt 6.

Figure 3:
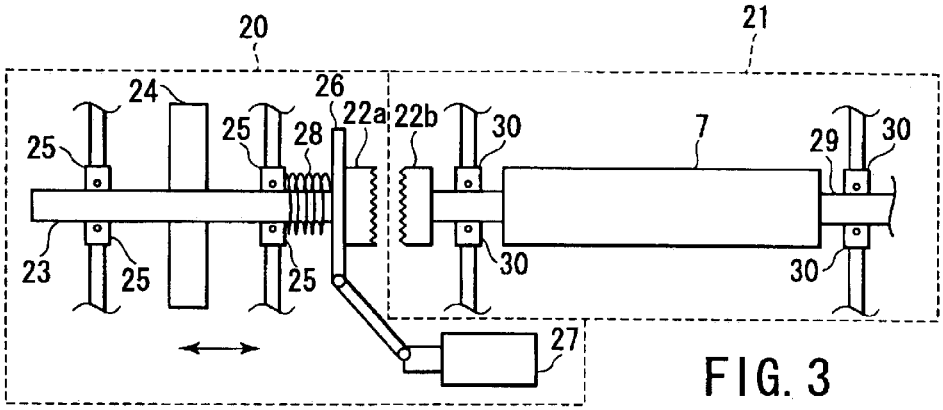
FIG. 3 is a view showing a drive unit and drum unit.

FIG. 3 is a view showing a practical form when any of the photosensitive drums 7Y, 7M, 7C and 7K are incorporated into the color copier 1.

A drum unit 21 is provided which has a photosensitive drum 7 and a drive unit 20 configured to transmit a drive force to the photosensitive drum 7 from a drive source such as a motor, not shown. By connecting a coupling member 22*a* of the drive unit 20 to a coupling member 22*b* of a drum unit 21, a drive force is transmitted from the drive unit 20 to the drum unit 21. The coupling member 22*a* of the drive unit 20 is coupled to a shaft 23 which is in mesh with a gear 24. The gear 24 is rotationaliy driven upon receipt of a drive force from the drive source such as a motor, not shown. The shaft 23 is supported by a plurality of bearings 25. A compression spring 28 is provided between a moving plate 26, which configured to be moved by a solenoid mechanism section 27, provided at a back surface of the coupling member 22*a* and the bearing 25 nearest on the coupling member 22*a* side to the moving plate. The drum 7 is rotated about a shaft 29. The shaft 29 is journalled by a plurality of bearings 30.

The solenoid mechanism section 27 operates a solenoid mechanism by a given instruction from a later-described control section 51 to move the moving plate 26 away from the photosensitive drum 7. In synchronism with the moving of the moving plate 26, the coupling member 22*a* is moved in a direction away from the drum unit 21. By doing so, the drive force from the gear 24 ceases to be transmitted to the drum unit 21. Further, when the operation of the solenoid mechanism is stopped by a given instruction of the control section 51, the coupling member 22*a* is moved under a reaction force of the compression spring 28 to be connected to the coupling member 22*b*. By doing so, the drive force from the gear 24 is transmitted to the photosensitive drum 7.

Figure 4:
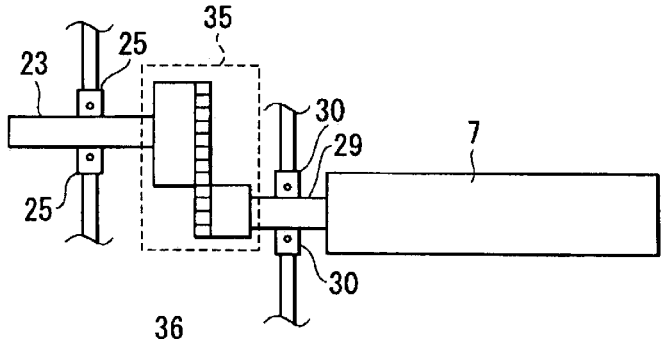
FIG. 4 is a view showing another practical form of drive unit and drum unit.
Figure 5:
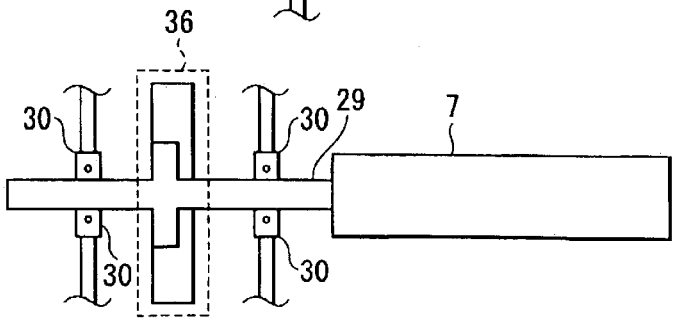
FIG. 5 is a view showing another practical form of drive unit and drum unit.

The mechanism for transmitting a drive force from the drive unit 20 to the drum unit 21 may be so configured as to transmits a drive force by means of an electromagnetic clutch 35, as shown in FIG. 4. Further, a drive force transmitting structure may be provided by a one-way clutch 36, configured to be rotated only in one direction and configured to be formed of shaft 23 and shaft 29 as shown in FIG. 5.

Figure 6:
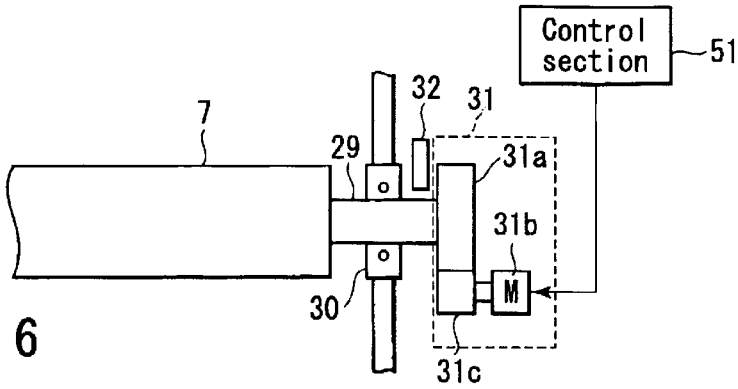
FIG. 6 is a view showing a phase matching unit.

FIG. 6 shows a mechanism of a phase matching section 31 for adjusting the phase of the photosensitive drum 7. The phase matching section 31 is coupled to the shaft 29 of the photosensitive drum 7. The phase matching section 31 is so arranged that a gear 31a rotated in synchronism with the rotation of the shaft 29 of the photosensitive drum 7 is set in mesh with a gear 31*c* which is driven by a drive source of motor 31*b*. The motor 31*b* has its drive controlled by the control section 51. The phase matching section 31 is of a one-way clutch type such that a drive force from the motor 31*b* is transmitted only when the gear 31*c* is rotated in a direction opposite to that in which the gear 31*a* is rotated. Further, a drum rotation angle read-out sensor 32 is set at a predetermined position near the shaft 29 to read out the rotation angle of the photosensitive drum 7.

It is to be noted that, although the drum rotation angle read-out sensors 32Y, 32M, 32C and 32K are provided in a way to correspond to the photosensitive drums 7Y, 7M, 7C and 7K for respective colors, the phase matching section 31 is provided in a way to correspond to the photosensitive drums 7Y, 7M and 7C other than that photosensitive drum serving as a standard for phase adjustment. This is because the rotation positions of these other photosensitive drums are adjusted to the reference photosensitive drum. As this standard drum, use is made, in this embodiment, of the photosensitive drum 7K for K color.

Figure 7:
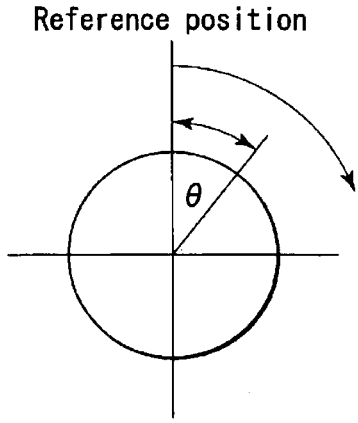
FIG. 7 is a view showing a reference position of a photosensitive drum.

Further, the rotation position of the photosensitive drum 7 has its given rotation standard position initially set as shown in FIG. 7. The drum rotation angle reading-out sensor 32 reads out the rotation angle of the photosensitive drum 7 from the standard position. The rotation angle from the standard position is indicated by θ.

Figure 8:
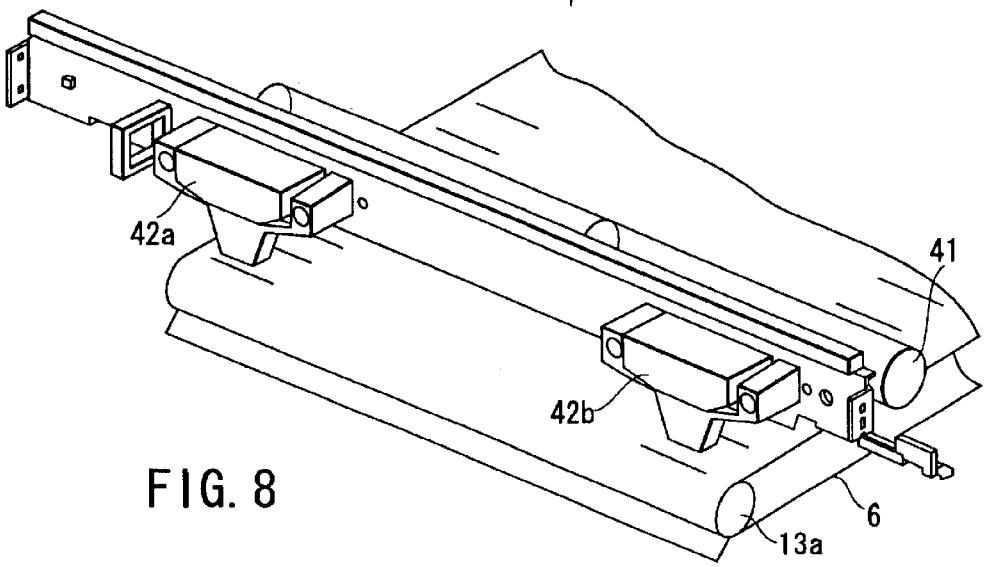
FIG. 8 is a view showing one practical form of an arrangement of sensors.

FIG. 8 shows one practical arrangement of sensors at a portion of a downstream side of the transfer belt 6 which read out respective color lines for image formation on the transfer belt. A bar-like member 41 is provided somewhat above the transfer belt in a direction orthogonal to the longitudinal direction of the transfer belt 6. Sensors 42*a*, 42*b* are arranged for detecting each color line transferred to a corresponding position at both end portions of the transfer belt 6.

Figure 9:
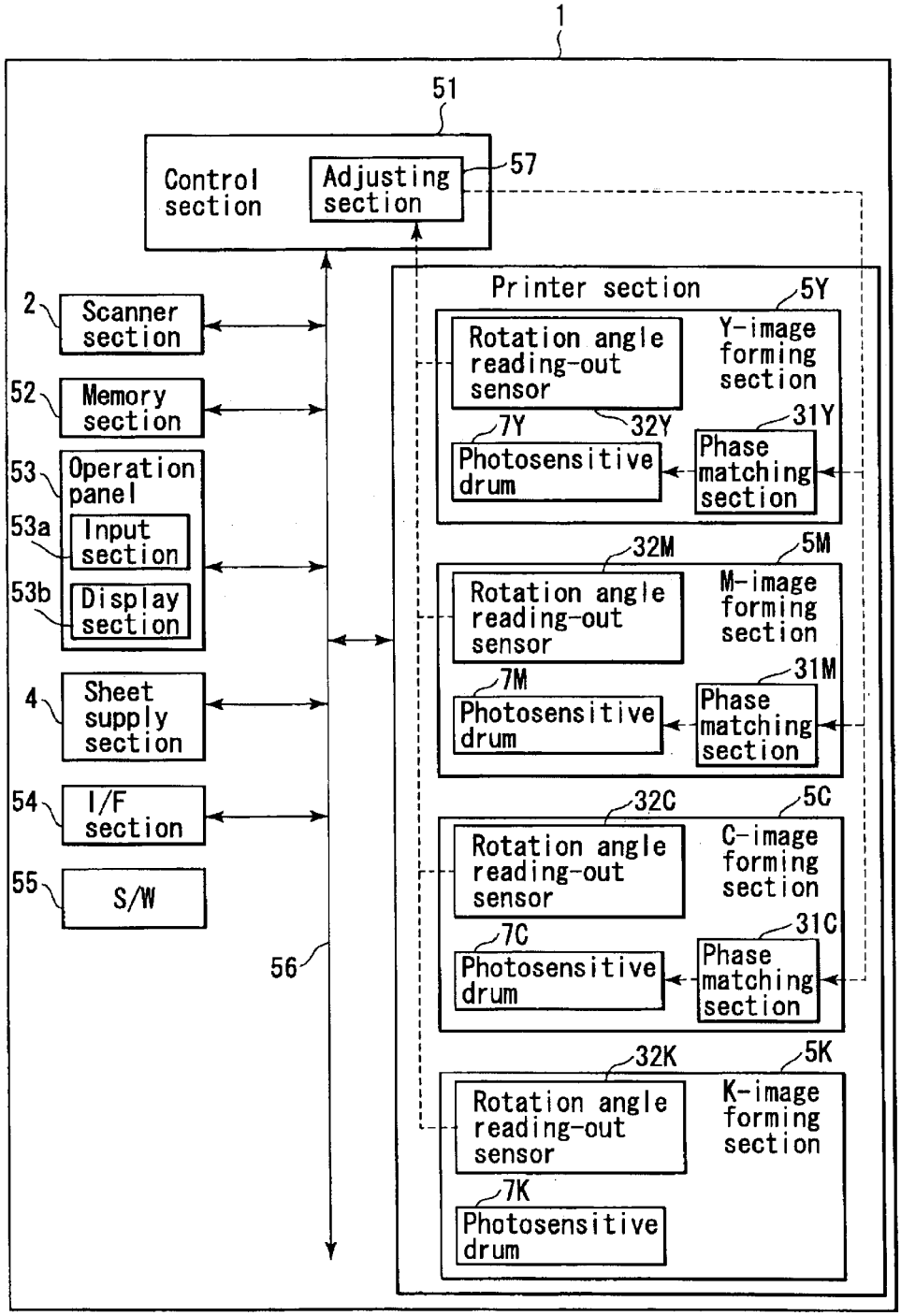
FIG. 9 is a view showing a general control structure of the color copier.

As shown in FIG. 9, a schematic control structure of the color copier 1 comprises the control section 51, scanner section 2, memory section 52, operation panel 53, sheet supply section 4, interface (I/F) section 54 and printer section 3. Further, the control section 51, scanner section 2, memory section 52, operation panel. 53, sheet supply section 4, printer section 3, and I/F section 54 are connected together via a bus line 56.

The control section 51 comprises a CPU, ROM, RAM, etc., not shown. Based on a control program stored in the ROM, the control section 51 implements various kinds of operations on the color copier 1. An adjusting section 57, which adjusts a color mismatching, is provided in the control section 51.

The scanner section 2 reads out image data from a document on the document glass 2*a* as set out above. The memory section 52 stores image data, etc., of the document read out by the scanner section 2. The sheet supply section 4 comprises cassettes for holding sheets to be supplied to the printer section 3, a mechanism for supplying a sheet to the printer section 3, etc., as shown in FIG. 1.

The operation panel 53 receives a user's instruction from an input section 53*a* under control of the control section 51. Further, the operation panel 53 displays information to be notified to the user at a display section 53*b* under control of the control section 51. A switch is set by the user to an ON/OFF state. With the switch is in the ON state, a power source is rendered ON on the color copier 1. The I/F section 54 is used to be connected to an external device, not shown.

The printer section 3 comprises the image forming sections 5Y, 5M, 5C and 5K for respective colors Y, M, C and K as set out above. In the image forming sections 5Y, 5M, 5C, drum rotation angle reading-out sensors 32Y, 32M and 32C and phase matching sections 31Y, 31M and 31C are provided, respectively. The image forming section 5K includes a drum section angle reading-out sensor 32K but does not have a phase matching section because it includes the reference photosensitive drum 7K. Further, a signal from the respective drum rotation reading-out sensor 32 is sent to the adjusting section 57 and a signal from the adjusting section 57 is sent to the phase matching section 31.

Figure 10:
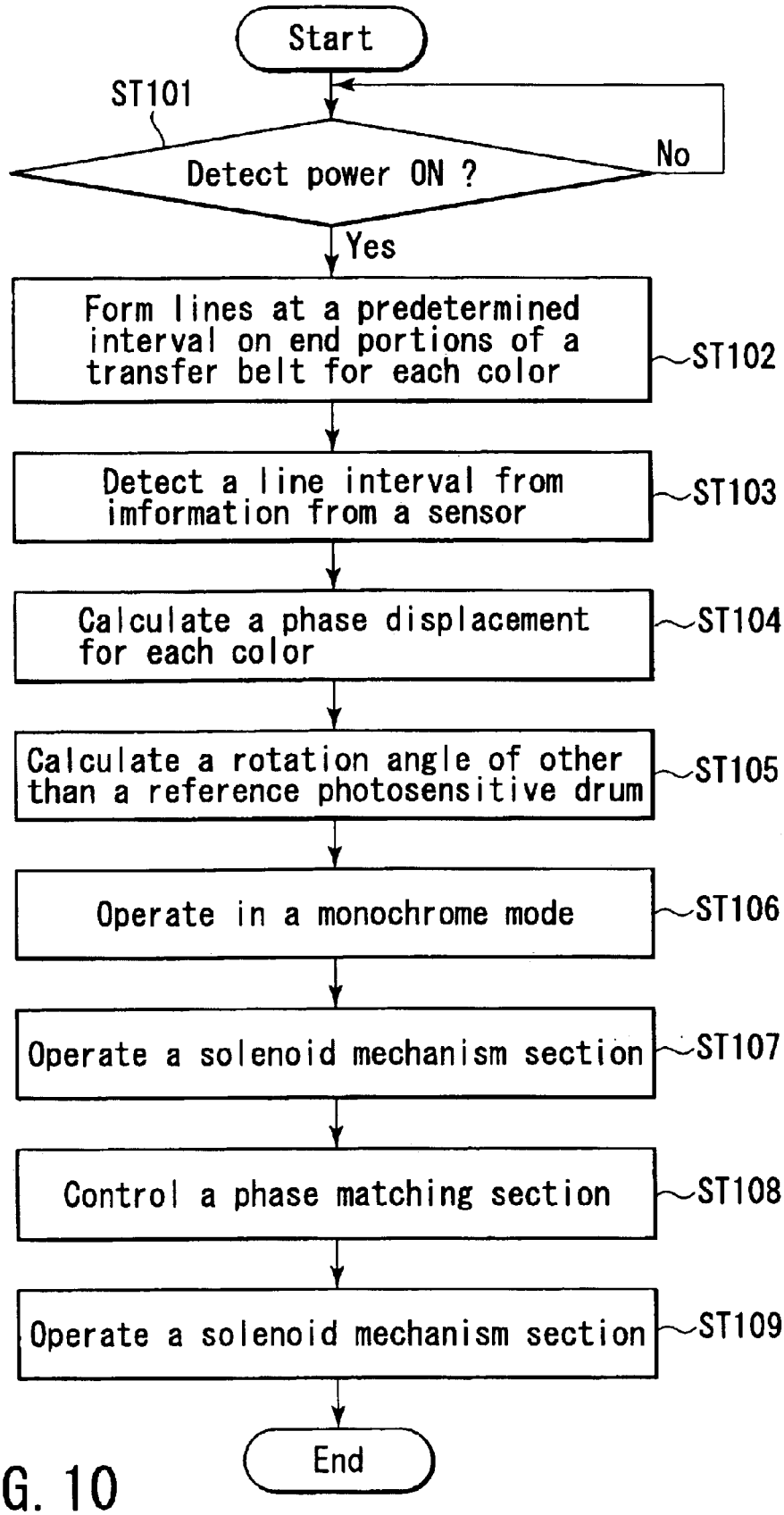
FIG. 10 is a flow chant showing the process of a control section.

With reference to FIG. 10, an explanation will be made below about the process of the adjusting section 57 for adjusting the rotation position of the photosensitive drum 7 of each color.

In step ST 101, the adjusting section 57 detects whether on not the power source is turned ON by rendering the switch 55 ON. If the adjusting section detects the ON state of the power source, in step ST 202, the adjusting section 57 controls the printer section 3 to form, for respective colors, lines at predetermined intervals at both end portions of the transfer belt 6 in a longitudinal direction of the photosensitive drum 7. Although the lines are formed on the transfer belt 6, lines for respective colors may be formed on a sheet coming from the sheet supply section 4. If such lines are formed on a sheet, then the sheet involved becomes wasteful but it is advantageous to accurately detect the intervals between the lines by the sensors 42*a*, 42*b*.

Figure 11:
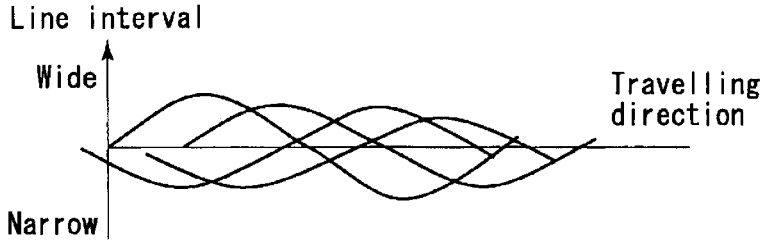
FIG. 11 is a view showing waveforms calculated from line intervals before a phase adjustment.

In step ST 103, the adjusting section 57 calculates, based on the information from the sensors 42*a*, 42*b*, the interval of lines for respective colors formed on the transfer belt 6. FIG. 11 conceptually shows waveforms which are calculated from the line intervals for respective colors with the line interval and transfer belt's running direction plotted on the ordinate and abscissa, respectively. The phase displacement of the waveforms are caused by the rotation vibration of the photosensitive drum 7. Since it is caused by the rotation vibration of the drum 7, a waveform of substantially the same locus is described for each one cycle rotation of the drum 7.

In step ST 104, the adjusting section 57 calculates a phase displacement from the calculated waveform as described above. That is, with a waveform of the K color as a reference, calculation is made about each phase difference from those waveforms for Y, M and C colors. The phase of the waveform is such that, when the photosensitive drum 7K for the K color, for example, is set to a position of angle θ, the interval of the waveform of the photosensitive drum 7C is set to the widest position. At this time, with θ' given as the widest waveform interval for the photosensitive drum 7C spaced a distance L apart on the transfer belt 6, a phase difference is so calculated as to satisfy $\theta'=\theta+2\pi L/\pi D$ (D: the diameter of the respective photosensitive drum) with respect to the drum 7K.

In step ST 105, the adjusting section 57 calculates the photosensitive drum's rotation angle based on the phase displacement between the photosensitive drum 7K as a standard and the photosensitive drum 7Y, 7M and 7C.

In step ST 106, the adjusting section 57 sets a monochrome mode for performing an image formation on the color copier 1. In this mode setting, the photosensitive drum 7K is set in close contact with the transfer belt 6 but the photosensitive drums 7Y, 7M and 7C are set away from the transfer belt 6. In this step ST 106, even if the monochrome mode is not set, it is possible to replace it by an operation for spacing all the photosensitive drums 7Y, 7M, 7C and 7K away from the transfer belt 6.

In step ST 107, the adjusting section 57 operates the solenoid mechanism section 27 of the drive units 20Y, 20M and 20 C and prevents a drive force from being transmitted from the gear 24.

In step ST 108, the adjusting section 57 controls the phase matching sections 31Y, 31M and 31C. That is, the rotation number of the motor for the phase matching sections 31Y, 31M and 31C is rotation-controlled by the rotation angle calculated in step ST 104. The rotation number of the photosensitive drums 7Y, 7M and 7C at this time is read out by the rotation angle reading-out sensor 32Y, 32M and 32C and, when the rotation is made through the calculated rotation angle, the adjusting is section 57 stops the photosensitive drums 7Y, 7M and 7C from being rotated.

In step ST 109, the adjusting section 57 operates the solenoid mechanism section 27 of the drive units 20Y, 20M and 20C and a drive force is transmitted from the corresponding gear 24. This completes the process for adjusting the position of the drum 7.

Figure 12:
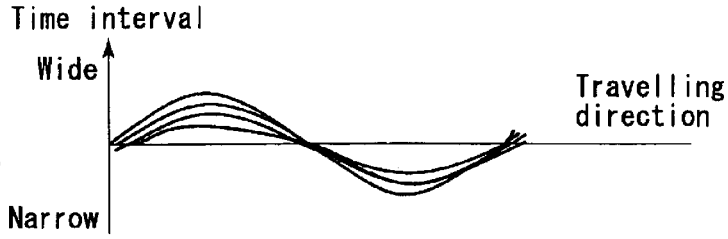
FIG. 12 is a view showing waveforms calculated from line intervals after the phase adjustment.

FIG. 12 shows practical waveforms calculated when the processes in steps ST 102 and ST 103 are done after adjustment has been made by the adjusting section 57. As shown in FIG. 12, adjustment is made to secure less phase displacement of the waveform. Since the rotation positions of the photosensitive drums 7Y, 7M and 7C are so adjusted as to match the phase of the drum 7K, it is possible to prevent color mismatching produced upon image formation. Further, the adjusting operation is performed each time to secure phase matching on the color copier 1 after the power source has been turned ON. Therefore, it is possible to cope with color mismatching which may be produced due to the rotation vibration resulting from ageing.

Further, at a time of the phase adjustment, the photosensitive drums 7Y, 7M and 7C are spaced apart from the transfer belt 6 since the monochrome mode is set, and it is possible to prevent any damage to the transfer belt 6 at a time of making the phase adjustment.

Further, the phase adjustment is set at a time the power source is turned ON. However, the adjusting section 57 may be so configured as to include a count section for counting the number of copied sheets and a memory area for storing the number of sheets, such as 100 or 200. In this case, the adjusting section 57 performs adjustment when the number counted by the count section reaches a set number of sheets. Further, a phase adjusting mode may be set to the input section 53*a* of the operation panel 53 to adjust the phase of the photosensitive drum 7 and the above-mentioned process may perform when this mode is set. Further, it is possible to provide all these structures and perform phase adjustment the user wishes.

(Second Embodiment)

An explanation will be made below about the second embodiment of the invention. The same reference numerals are employed to designate parts or elements corresponding to those shown in the first embodiment. A detailed description is omitted.

Figure 13A:
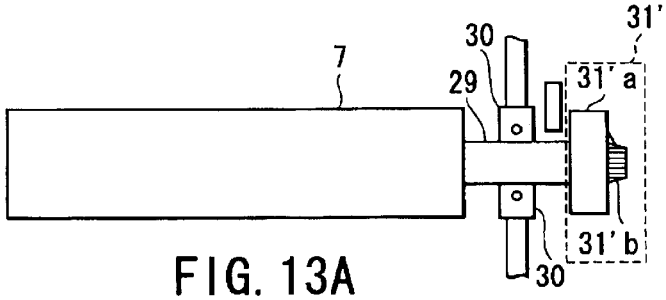
FIG. 13A is a view showing another form of a phase matching section.
Figure 13B:
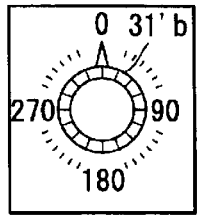
FIG. 13B is a view showing one form of a dial.

As shown in FIG. 13A, as phase matching section 31' use is made of a rotation angle adjusting dial 31'*b* provided on an end 31'*a* of a substantially cylindrical body coupled to a photosensitive drum 7. The dial 31' is so configured as to be able to rotate through an angle of 360' as shown in FIG. 13B. The angle of the photosensitive drum 7 is adjusted in synchronism with the angle of the dial 31' by the user. Even in this embodiment, a photosensitive drum 7K serves as a reference photosensitive drum.

A key for an adjusting mode for adjusting the position of the photosensitive drum 7 is provided on an input section 53*a* of an operation panel 53. When this key is depressed by the user as an input operation, the processes in steps ST 102 to ST 105 as set out above are performed. That is, the phase mismatching of the photosensitive drums 7Y, 7M and 7C relative to the photosensitive drum 7K are calculated based on the interval of those lines detected by sensors 42*a*, 42*b*, and rotation angles for adjusting the rotation positions of the photosensitive drums 7Y, 7M and 7C relative to the reference photosensitive drum 7K are calculated, etc. And the rotation angle as a result of the process is displayed on a display section 53*b* of the operation panel 53*b*. The user, after seeing this display, rotates the dial 31'*b* of the drums 7Y, 7M and 7C through displayed angle and, while the angle is adjusted by the user, the photosensitive drums 7Y, 7M and 7C are so set in a spaced-apart state as in steps ST 107 and ST 109 to prevent a drive force-from being transmitted from a gear 24. Setting the photosensitive drums 7Y, 7M and 7C in close contact with, and away from, a transfer belt is accomplished by, for example, operating the input section 53*a* of the operation panel 53.

Even in such a structure, it is possible to prevent color mismatching which may be produced at the formation of an image on the color copier 1. Since the adjustment of the dial 31'*b* is performed by the user, a phase adjusting control structure can be simplified and a resultant color copier can be made lower in cost.

Figure 14:
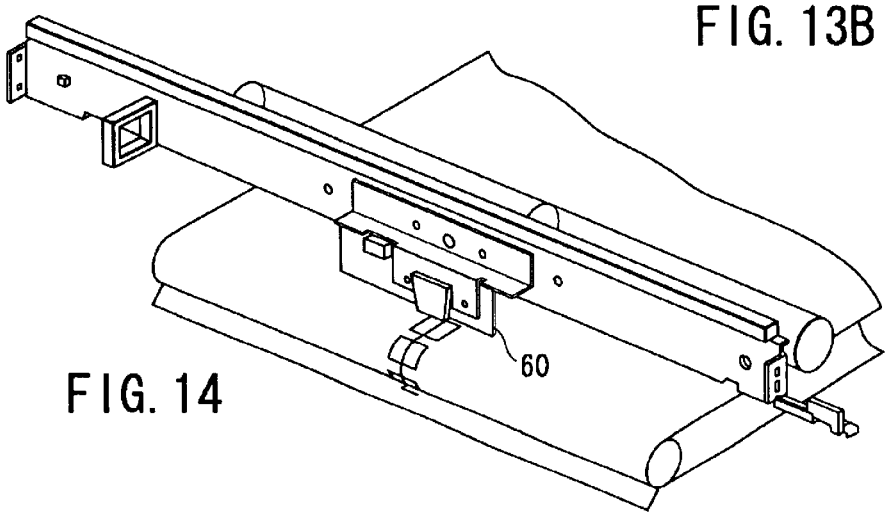
FIG. 14 is a view showing an arrangement of a sensor configured to read out color information or density information.

In both the embodiments above, it is possible to obtain a rotation angle through which the photosensitive drums 7Y, 7M and 7C are rotated based on lines for respective colors which are formed at the end portions of the transfer belt 6. As shown in FIG. 14, however, a sensor 60 may be provided to read out color information or concentration information formed on the transfer belt 6 and, based on this information, any phase mismatch can be read out.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the invention as defined by the appended claims and equivalents thereof.

What is claimed is:

1. An image forming apparatus comprising:

photosensitive bodies each rotatable about a predetermined axis and provided to form a color image for respective colors;

light exposure sections provided for the respective colors and configured to form a latent image corresponding to a line-like image of a predetermined pitch in an axial direction of the respective photosensitive body;

developing sections provided for the respective colors and configured to supply color developing agents corresponding to the respective photosensitive bodies to allow the latent image which corresponds to the line-like image of the predetermined pitch to be developed;

a transfer belt configured to allow the developed line-like image of a predetermined pitch for the respective color to be transferred;

sensors arranged at a predetermined position and configured to detect the transferred line-like image formed for the respective color; and an adjusting section configured to, based on the phases of waveforms for the respective colors calculated from the pitch of lines for respective colors which have been detected, relative to the phase of a given photosensitive body adjust the rotation positions of the other photosensitive bodies to allow the phases of the other photosensitive bodies to be substantially matched to the phase of the given photosensitive body.

2. An image forming apparatus according to claim 1, further comprising a rotation angle reading-out sensor configured to read out a rotation angle of the photosensitive body for the respective color and a phase matching section coupled to the other photosensitive bodies, wherein the adjustment of the adjusting section is done by controlling the phase matching section in a predetermined timing on the basis of an angle read out by the rotation angle reading-out sensor.

3. An image forming apparatus according to claim 1, further comprising a dial coupled to the other photosensitive bodies and configured to display a rotation angle through which the rotation is made; a calculation section configured to calculate the rotation angle to allow the phases of the other photosensitive bodies to be substantially matched to that of the one photosensitive body; and a display section configured to display the calculated rotation angle, wherein the adjustment of the adjusting section is such that, upon receipt of a dial operation, the rotation is made through a rotation angle displayed on the display section.

4. A method for preventing a color mismatching on an image forming apparatus comprising:

forming a latent image corresponding to a line-like image of a predetermined pitch in an axial direction on photosensitive bodies rotatable along predetermined shafts and provided for respective colors with which a color image is formed;

supplying color developing agents to the respective photosensitive bodies to develop a latent image corresponding to the line-like image;

transferring the developed line-like image of a predetermined pitch for the respective color;

detecting the transferred line-like image formed for the respective color; and relative to the phase of a given photosensitive body adjusting the rotation position of the other photosensitive bodies to allow the phases of the other photosensitive bodies to be substantially matched to the phase of the given photosensitive body, based on the phases of waveforms for respective colors calculated from the pitch of lines for respective colors which have been detected.

5. A method according to claim 4, further comprising reading out the rotation angles of the photosensitive bodies wherein the adjusting is carried out by controlling a phase matching section coupled to the other photosensitive bodies, in a predetermined timing, on the basis of the read-out rotation angle.

6. A method according to claim 4, further comprising: calculating a rotation angle through which a rotation is effected to allow the phases of the other photosensitive bodies to be substantially matched to the phase of the given photosensitive body, and displaying the calculated rotation angle, wherein the adjusting is effected by making a rotation through an indicated rotation angle upon receipt of a rotation operation of a dial coupled to the photosensitive body and configured to display that rotation angle.

* * * * *